US011519270B2

(12) United States Patent
Xu et al.

(10) Patent No.: US 11,519,270 B2
(45) Date of Patent: Dec. 6, 2022

(54) OIL SUPPLY TO THE BACK PRESSURE GROOVE OF A VANE PUMP

(71) Applicant: Gree Electric Appliances, Inc. of Zhuhai, Zhuhai (CN)

(72) Inventors: Jia Xu, Zhuhai (CN); Fayou Luo, Zhuhai (CN); Pengkai Wan, Zhuhai (CN); Fei Wu, Zhuhai (CN); Ning Ding, Zhuhai (CN); Shuang Guo, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 0 days.

(21) Appl. No.: 17/254,378

(22) PCT Filed: Aug. 22, 2019

(86) PCT No.: PCT/CN2019/102052
§ 371 (c)(1),
(2) Date: Dec. 21, 2020

(87) PCT Pub. No.: WO2020/052418
PCT Pub. Date: Mar. 19, 2020

(65) Prior Publication Data

US 2021/0270268 A1 Sep. 2, 2021

(30) Foreign Application Priority Data

Sep. 12, 2018 (CN) ..... 201811062779.4

(51) Int. Cl.
*F01C 21/08* (2006.01)
*F04C 29/02* (2006.01)
*F04C 18/344* (2006.01)

(52) U.S. Cl.
CPC ..... *F01C 21/0872* (2013.01); *F04C 18/3441* (2013.01); *F04C 18/3446* (2013.01); *F04C 29/02* (2013.01); *F04C 29/023* (2013.01)

(58) Field of Classification Search
CPC ..... F01C 21/0872; F04C 18/3441; F04C 18/3446; F04C 29/02; F04C 29/023
See application file for complete search history.

(56) References Cited

FOREIGN PATENT DOCUMENTS

CN 204900245 U 12/2015
CN 105275815 A 1/2016
(Continued)

OTHER PUBLICATIONS

International Search Report for corresponding PCT/CN2019/102052, dated Nov. 20, 2019, 3 pages.
(Continued)

*Primary Examiner* — Mary Davis
(74) *Attorney, Agent, or Firm* — Armstrong Teasdale LLP

(57) ABSTRACT

A pump body assembly and a compressor with the pump body assembly. The pump body assembly includes: an oil supply passage for circulating oil; and two back pressure members, at least one of the two back pressure members being provided with a back pressure groove, the back pressure groove including a first groove section and a second groove section, the first groove section and the second groove section are disposed at intervals, the first groove section communicating with the oil supply passage, the second groove section communicating with the oil supply passage, wherein the communication area of the first groove section and the oil supply passage is a, the communication area of the second groove section and the oil supply passage is b, and a<b.

19 Claims, 20 Drawing Sheets

(56) References Cited

FOREIGN PATENT DOCUMENTS

| | | | | |
|---|---|---|---|---|
| CN | 105402125 | A | * | 3/2016 |
| CN | 105402125 | A | | 3/2016 |
| CN | 105909525 | A | | 8/2016 |
| CN | 106704184 | A | * | 5/2017 |
| CN | 106704184 | A | | 5/2017 |
| CN | 107882728 | A | | 4/2018 |
| CN | 108869285 | A | | 11/2018 |
| CN | 208749550 | U | | 4/2019 |
| EP | 2677118 | A1 | | 12/2013 |
| JP | S59103982 | A | | 6/1984 |
| JP | 3014204 | B2 | | 2/2000 |

OTHER PUBLICATIONS

Supplementary European Search Report for corresponding European Application No. 19860387, dated Feb. 26, 2021, 7 pages.

* cited by examiner

OIL SUPPLY TO THE BACK PRESSURE GROOVE OF A VANE PUMP

CROSS-REFERENCE TO RELATED APPLICATIONS

The present application is a National Stage entry of International Patent Application No. PCT/CN2019/102052, filed Aug. 22, 2019, which claims the priority of Chinese Patent Application No. 201811062779.4, filed Sep. 12, 2018, and entitled "Pump Body Assembly and Compressor with Pump Body Assembly," which are herein incorporated by reference in their entirety.

TECHNICAL FIELD

The disclosure relates to a technical field of compressors, in particular to a pump body assembly and a compressor with the pump body assembly.

BACKGROUND

Compared with other types of compressors, the sliding vane compressor has the advantages of simple parts, no-eccentric structure, stable moment and small vibration and the like. But the sliding vane compressor also has a defect influencing the energy efficiency of the sliding vane compressor, namely the power consumption of the sliding vane head portions is too large. The sliding vane compressor pushes a sliding vane out of a sliding vane groove and makes it abut against the inner wall of a cylinder to form a seal through centrifugal force or sliding vane back pressure. Since the rotation radius of the sliding vane head portion is large, the linear velocity is large during operation, so that the friction power consumption generated when the sliding vane head portion contacts with the cylinder is large. In addition, the number of the sliding vane is large such that the power consumption of the sliding vane head portion is the main mechanical power consumption source of the sliding vane compressor.

In a specific use, as shown in FIG. 1, to enable the sliding vane to always abut against the inner wall of the cylinder during operation, high-pressure oil introduced into a shell cavity at the tail portion of the sliding vane groove is generally used for providing back pressure to ensure that the sliding vane cannot be retracted by the head portion pressure during operation. The calculation formula of the sliding vane head portion power consumption of the sliding vane machine can be simply expressed as follows: $W=f\cdot v$, wherein v is the component of the linear velocity of the sliding vane head portion in the direction of the friction force and is related to the structure and the rotating velocity of the sliding vane machine pump body; f is the friction force between the sliding vane head portion and the cylinder, and the product of the component of the difference between the sliding vane back pressure F1 and the sliding vane head portion gas force F2 and the friction coefficient μ. Therefore, the sliding vane head portion power consumption calculation can be expressed as: $W=\mu v\ (F1-F2)$ cost.

In the suction section, because the sliding vane head portion pressure F2 is provided by the suction pressure, namely value of F1–F2 is large, the sliding vane head portion power consumption W of the suction section is large such that the reliability of the sliding vane and the performance of the compressor are influenced. In the exhaust section, due to the existence of over-compression of exhaust gas, the actual pressure at the sliding vane head portion F2 is equal or greater than the exhaust pressure F; and since the sliding vane back pressure oil is the high-pressure oil in the shell reaching the tail of the sliding vane through a certain length of the channel, the certain pressure drop along the path would be caused, namely F1 is equal or lesser than the exhaust pressure F. So the value of F1–F2 is close to zero or even negative. In addition, the centrifugal force of the sliding vane is very small relative to the gas force. When the cavity body is over-compressed or the back pressure fluctuates, insufficient pressure at the tail portion of the sliding vane may be caused, namely, the sliding vane has the risk of separating from the inner wall of the cylinder and returning to the sliding vane groove, so it is easy to cause the colliding of the sliding vane, the performance and the noise of the compressor are influenced, and the reliability of the sliding vane is also very unfavorable.

SUMMARY

The main purpose of the present disclosure is to provide a pump body assembly and a compressor with the pump body assembly, so as to solve the problem of large power consumption of the sliding vane head portion of the pump body assembly in a suction section in device known to the inventors.

To achieve the above object, according to one aspect of the present disclosure, a pump body assembly is provided, including an oil supply passage configured for circulating oil; h two back pressure members, wherein at least one back pressure member of the two back pressure members is provided with a back pressure groove, the back pressure groove includes a first groove section and a second groove section, the first groove section and the second groove section are disposed at intervals, the first groove section is communicated with the oil supply passage, and the second groove section is communicated with the oil supply passage; wherein a communication of the first groove section and the oil supply passage is a, and a communication of the second groove section and the oil supply passage is b, and $a<b$.

In some embodiments, the oil supply passage includes: a flow passage disposed on the at least one back pressure member, wherein the flow passage includes a first flow passage and a second flow passage, the first flow passage is communicated with the first groove section, and the second flow passage is communicated with the second groove section; wherein an area of a first opening, communicated with the first groove section, of the first flow passage is a, and an area of a second opening, communicated with the second groove section, of the second flow passage is b.

In some embodiments, the pump body assembly further includes a rotary shaft which passes through the two back pressure members, and the oil supply passage further includes an oil passage disposed on the rotary shaft, wherein the oil passage is communicated with the first flow passage and the oil passage is communicated with the second flow passage.

In some embodiments, the oil supply passage further includes: an oil cavity provided on at least one back pressure member, wherein the oil cavity is communicated with the oil passage and the oil cavity is communicated with the flow passage so that the oil passage is communicated with the first flow passage through the oil cavity, and the oil passage is communicated with the second flow passage through the oil cavity; wherein the flow passage is disposed between the oil cavity and the back pressure groove.

In some embodiments, the back pressure groove further includes: a third groove section, wherein the second groove section is disposed between the third groove section and the first groove section; wherein the width of the third groove section is smaller than the width of the second groove section.

In some embodiments, the third groove section is communicated with the oil supply passage.

In some embodiments, the third groove section is communicated with the second groove section.

In some embodiments, a cross-section of the first flow passage is of circular-shaped or polygonal-shaped, and/or a cross-section of the second flow passage is of circular-shaped or polygonal-shaped.

In some embodiments, the first groove section is an arc groove and/or the second groove section is an arc groove.

In some embodiments, the two back pressure members are an upper flange and a lower flange respectively, and the back pressure groove is provided on an end face, facing the lower flange, of the upper flange; and/or the back pressure groove is provided on an end face, facing the upper flange, of the lower flange.

In some embodiments, there are a plurality of the back pressure grooves, each of the upper flange and the lower flange is provided with the back pressure groove, and a projection of the back pressure groove on the upper flange to the lower flange coincides with the back pressure groove on the lower flange.

In some embodiments, the two back pressure members are an upper flange and a lower flange respectively, the back pressure groove is provided on the end face, facing the lower flange, of the upper flange, the back pressure groove is provided on the end face, facing the upper flange, of the lower flange, and the lower flange is provided with at least part of the oil supply passage.

In some embodiments, the pump body assembly further includes a pump body, and an oil outlet of the pump body is communicated with the oil supply passage so that the pump body conveys the oil in the oil tank into the oil supply passage.

According to another aspect of the present disclosure, a compressor is provided, including a pump body assembly as described above.

According to the pump body assembly disclosed by the disclosure, by reducing the communication area of the first groove section and the oil supply passage, the oil inlet quantity in the sliding vane tail groove can be reduced in the suction section of the pump body assembly so that the pressure difference between the two ends of the sliding vane is reduced, and the power consumption of the sliding vane head portion can be reduced. In the suction section of the pump body assembly, the sliding vane tail groove is communicated with the first groove section, and the oil enters the sliding vane groove through the oil supply passage and the first groove section sequentially. In the oil inlet process, the communication area of the first groove section and the oil supply passage is small so that the oil inlet quantity in the sliding vane tail groove is reduced and the pressure difference between the two ends of the sliding vane is reduced. In the compression section, the sliding vane tail groove is communicated with the second groove section, and the oil enters the sliding vane groove through the oil supply passage and the second groove section sequentially. In the oil inlet process, because the communication area of the second groove section and the oil supply passage is larger than the communication area of the first groove section and the oil supply passage, the oil inlet quantity in the sliding vane tail groove is increased. This ensures that the pressure difference between the two sides of the sliding vane is sufficient to locate the sliding vane in a reliable position. According to the pump body assembly of the disclosure, by reducing the communication area of the first groove section and the oil supply passage, the oil inlet quantity in the sliding vane tail groove can be reduced in the suction section of the pump body assembly so that the pressure difference between the two ends of the sliding vane is reduced, the power consumption of the sliding vane head portion can be reduced, and the problem of large power consumption of the sliding vane head portion in the suction section of the pump body assembly is solved.

BRIEF DESCRIPTION OF THE DRAWINGS

The accompanying drawings, which are incorporated in and constitute a part of this disclosure, serve to provide a further understanding of the disclosure. The illustrative embodiments of the disclosure and the description thereof are used to explain the disclosure, and do not constitute an improper limitation of the disclosure. In the drawings.

Figure 1:
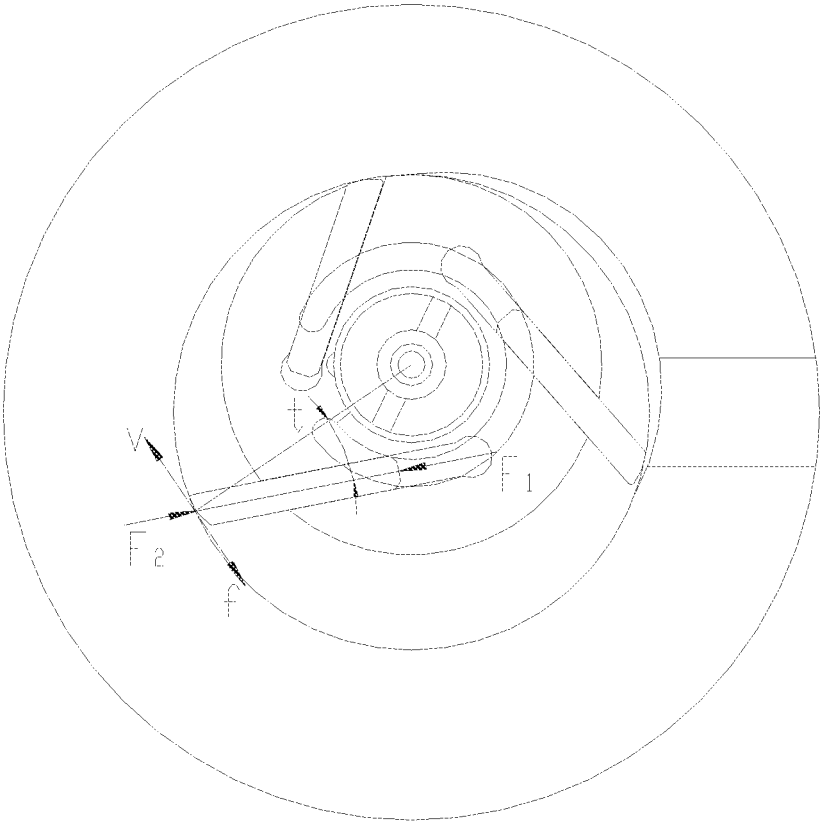
FIG. 1 shows a schematic cross-sectional structural diagram of a pump body assembly in the device known to the inventors.

The above figures include the following reference numerals:

10, a back pressure groove; 11, a first groove section; 12, a second groove section; 13, a third groove section; 20, a rotary shaft; 21, a sliding vane groove; 22 an oil passage; 221, a central hole; 222, a radial hole; 30, a sliding vane; 31, a sliding vane tail groove; 40, a flow passage; 41, a first flow passage; 42, a second flow passage; 50 an oil cavity; 60, an upper flange; 70 a lower flange; 80 a pump body; 90 a cylinder; 100, a screw; 110, an exhaust valve; 120, a suction port.

DETAILED DESCRIPTION OF THE EMBODIMENTS

It should be noted that the embodiments and features in the embodiments herein may be combined with one another without conflict. The present disclosure will now be described in detail, by way of embodiments, with reference to the accompanying drawings.

It is to be understood that the following detailed description is exemplary and is intended to provide further explanation of the disclosure. Unless defined otherwise, all technical and scientific terms used herein have the same meaning as commonly understood by one of ordinary skill in the art to which this disclosure belongs.

It is noted that the terminology used herein is only for the purpose of describing particular embodiments and is not intended to be limiting of the exemplary embodiments in accordance with the present disclosure. As used herein, the singular form is intended to include the plural form unless the context clearly dictates otherwise. Furthermore, it is to be understood that the terms "includes" and/or "including", when used in this description, specify the presence of features, steps, operations, devices, assemblies, and/or combinations thereof.

The present disclosure provides a pump body assembly, with reference to FIGS. 2-20, including: an oil supply passage for circulating oil; and two back pressure members, at least one of the two back pressure members is provided with a back pressure groove 10, the back pressure groove 10 includes a first groove section 11 and a second groove section 12, the first groove section 11 and the second groove section 12 are disposed at intervals, the first groove section 11 is communicated with the oil supply passage, the second groove section 12 is communicated with the oil supply passage, wherein the communication area of the first groove section 11 and the oil supply passage is a, the communication area of the second groove section 12 and the oil supply passage is b, and a<b.

According to the pump body assembly disclosed by the disclosure, by reducing the communication area of the first groove section 11 and the oil supply passage, the oil inlet quantity in the sliding vane tail groove 31 can be reduced in the suction section of the pump body assembly so that the pressure difference between the two ends of the sliding vane 30 is reduced, and the power consumption of the sliding vane head portion 30 can be reduced. In the suction section of the pump body assembly, the sliding vane tail groove 31 is communicated with the first groove section 11, and the oil enters the sliding vane groove 21 through the oil supply passage and the first groove section 11 sequentially. In the oil inlet process, the communication area of the first groove section 11 and the oil supply passage is small so that the oil inlet quantity in the sliding vane tail groove 31 is reduced and the pressure difference between the two ends of the sliding vane 30 is reduced. In the compression section, the sliding vane tail groove 31 is communicated with the second groove section 12, and the oil enters the sliding vane groove 21 through the oil supply passage and the second groove section 12 sequentially. In the oil inlet process, because the communication area of the second groove section 12 and the oil supply passage is larger than the communication area of the first groove section 11 and the oil supply passage, the oil inlet quantity in the sliding vane tail groove 31 is increased. This ensures that the pressure difference between two sides of the sliding vane 30 is sufficient to locate the sliding vane 30 in a reliable position. According to the pump body assembly of the disclosure, by reducing the communication area of the first groove section 11 and the oil supply passage, the oil inlet quantity in the sliding vane tail groove 31 can be reduced in the suction section of the pump body assembly so that the pressure difference between the two ends of the sliding vane 30 is reduced, the power consumption of the sliding vane head portion 30 can be reduced, and the problem of large power consumption of the sliding vane head portion in the suction section of the pump body assembly is solved.

In the present embodiment, the pump body assembly further includes: a rotary shaft 20 which passes through the two back pressure members, and the rotary shaft 20 is provided with a sliding vane groove 21; a sliding vane 30 slidably arranged in the sliding vane groove 21, wherein a sliding vane tail groove 31 is formed between the sliding vane 30 and the sliding vane groove 21, the sliding vane tail groove 31 and the first groove section 11 are arranged in an on-off mode, and the sliding vane tail groove 31 and the second groove section 12 are arranged in an on-off mode.

In the present embodiment, the sliding vane tail groove 31 communicates with the first groove section 11 during the suction section of the pump body assembly when the rotary shaft 20 rotates the sliding vane 30. Accordingly, the sliding vane tail groove 31 communicates with the second groove section 12 during the compression section.

Figure 4:
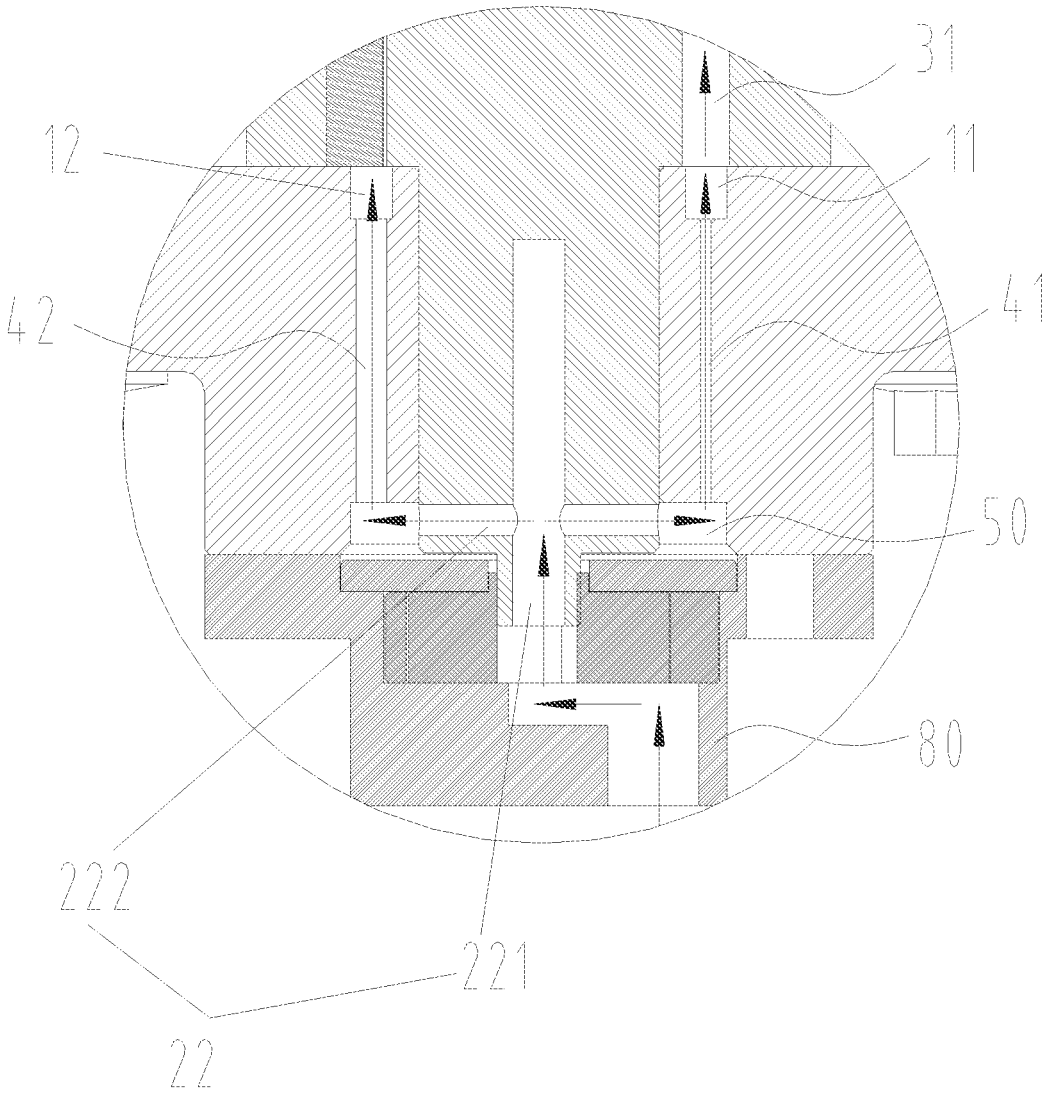
FIG. 4 shows a schematic partially enlarged structural diagram of the pump body assembly of part A in FIG. 3.
Figure 13:
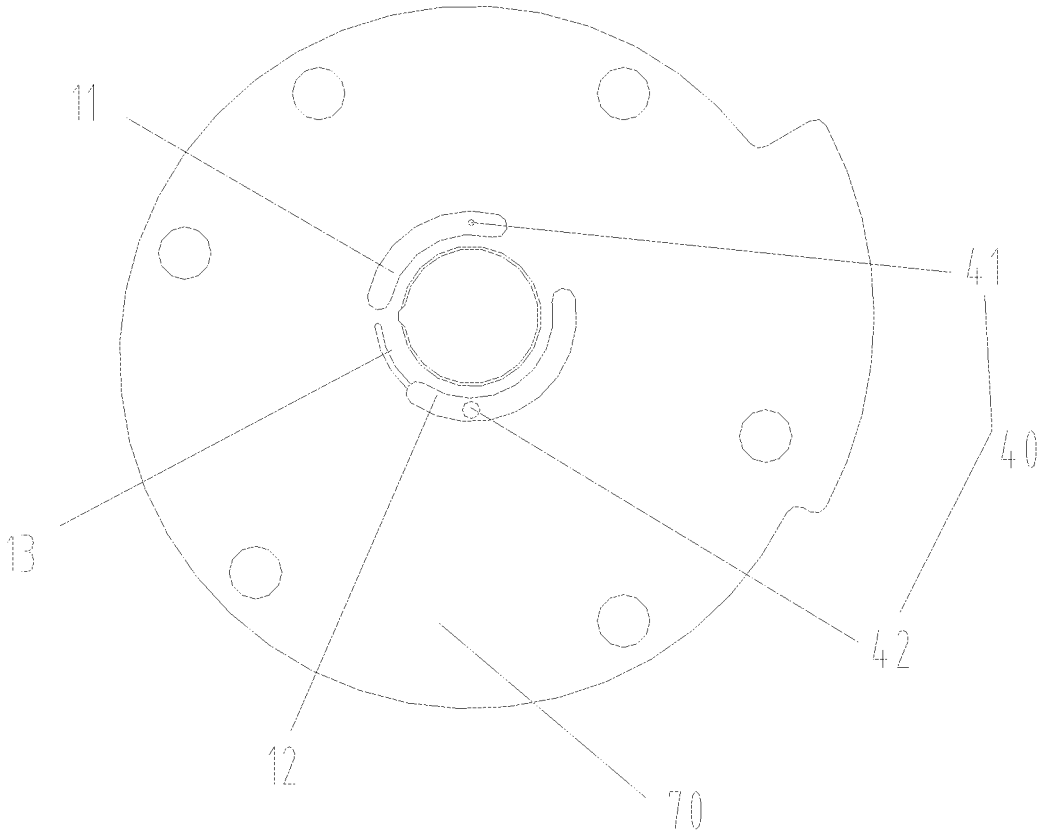
FIG. 13 shows a schematic structural diagram of the third viewing angle of a lower flange of a pump body assembly according to the present disclosure.
Figure 14:
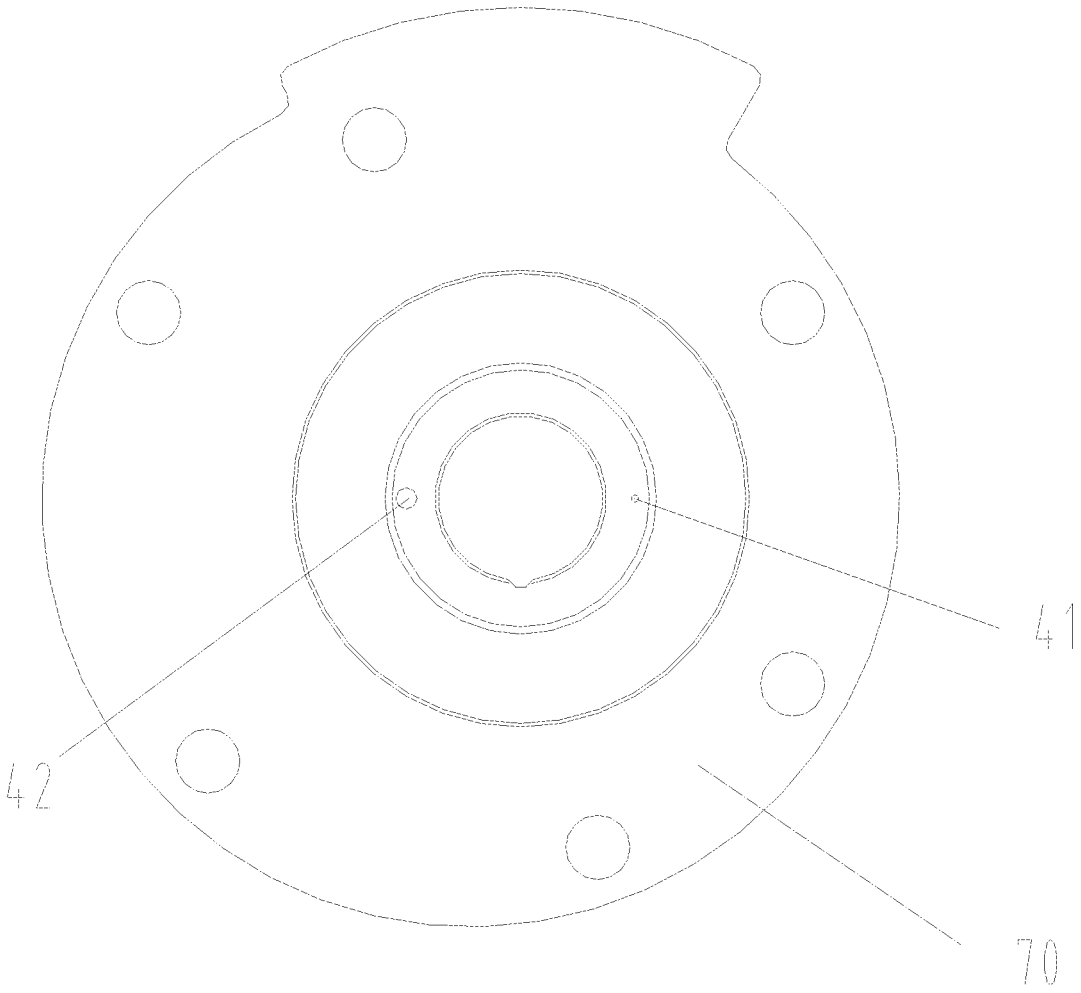
FIG. 14 shows a schematic structural diagram of the fourth viewing angle of a lower flange of a pump body assembly according to the present disclosure.

In order to enable the communication area of the first groove section 11 and the oil supply passage to be smaller than the communication area of the second groove section 12 and the oil supply passage, as shown in FIG. 4 and FIG. 13, the oil supply passage includes: a flow passage 40 arranged on at least one back pressure member, wherein the flow passage 40 includes a first flow passage 41 and a second flow passage 42, the first flow passage 41 is communicated with the first groove section 11, and the second flow passage 42 is communicated with the second groove section 12; the area of a first opening, communicated with the first groove section 11, of the first flow passage 41 is a, and the area of a second opening, communicated with the second groove section 12, of the second flow passage 42 is b.

In the present embodiment, the area of the first opening, communicated with the first groove section 11, of the first flow passage 41 is a, that is, the area of the oil outlet of the first flow passage 41 is a; the area of the second opening, communicated with the second groove section 12, of the second flow passage 42 is b, that is, the area of the oil outlet of the second flow passage 42 is b.

Figure 2:
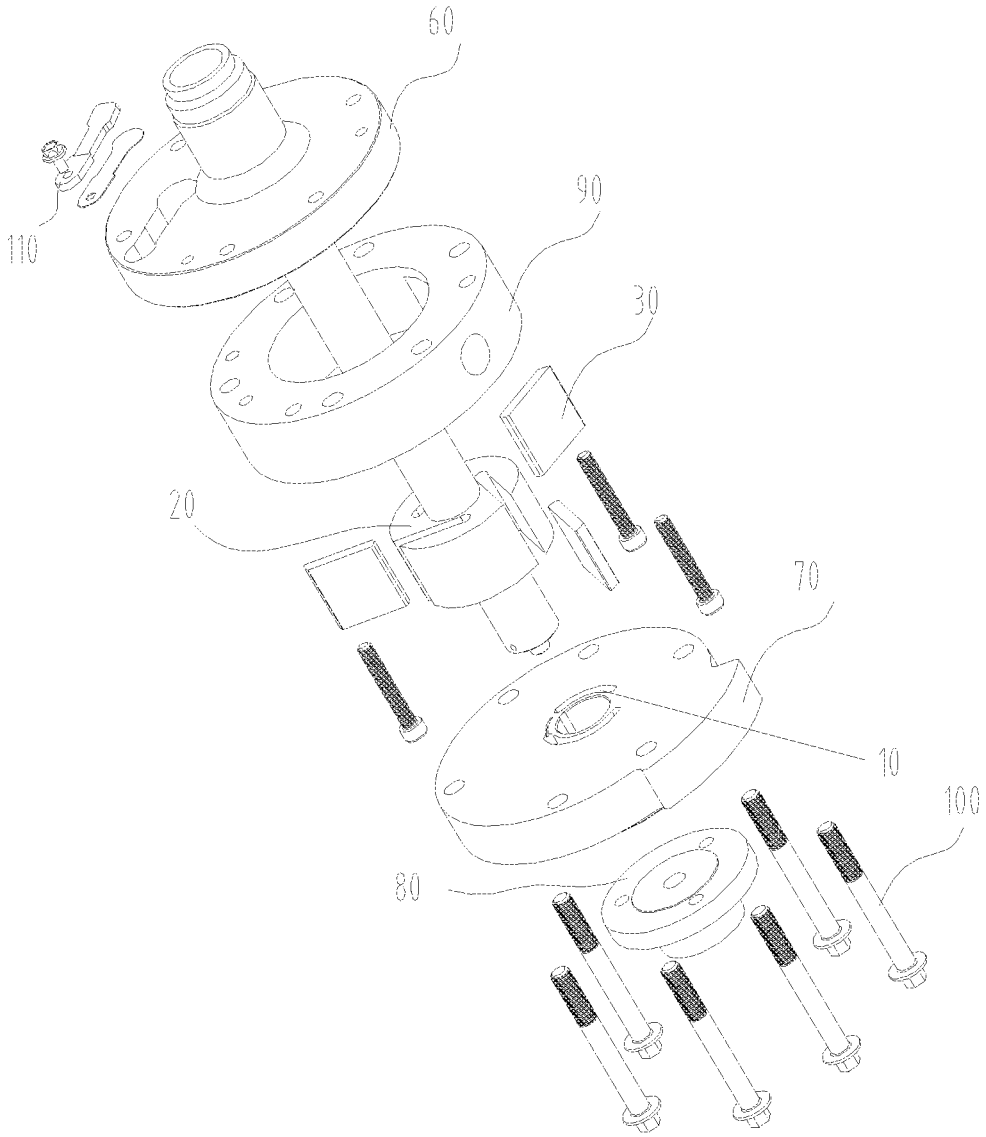
FIG. 2 shows a schematic exploded structural diagram of an embodiment of a pump body assembly according to the present disclosure.

In order to introduce the lubricating oil in the pump body assembly into the flow passage 40, as shown in FIG. 2 and FIG. 4, the pump body assembly further includes a rotary shaft 20, wherein the rotary shaft 20 passes through the two back pressure members, and the oil supply passage further includes: an oil passage 22 disposed on the rotary shaft 20, wherein the oil passage 22 is communicated with the first flow passage 41 and the oil passage 22 is communicated with the second flow passage 42.

In the present embodiment, by providing the oil passage 22 on the rotary shaft 20, the lubricating oil flows in the oil inlet of the oil passage 22. The oil outlet of the oil passage 22 communicates with both the first flow passage 41 and the second flow passage 42 so that the lubricating oil in the pump body assembly flows into the first flow passage 41 and the second flow passage 42 through the oil passage 22 and then into the corresponding first groove section 11 and second groove section 12.

Figure 12:
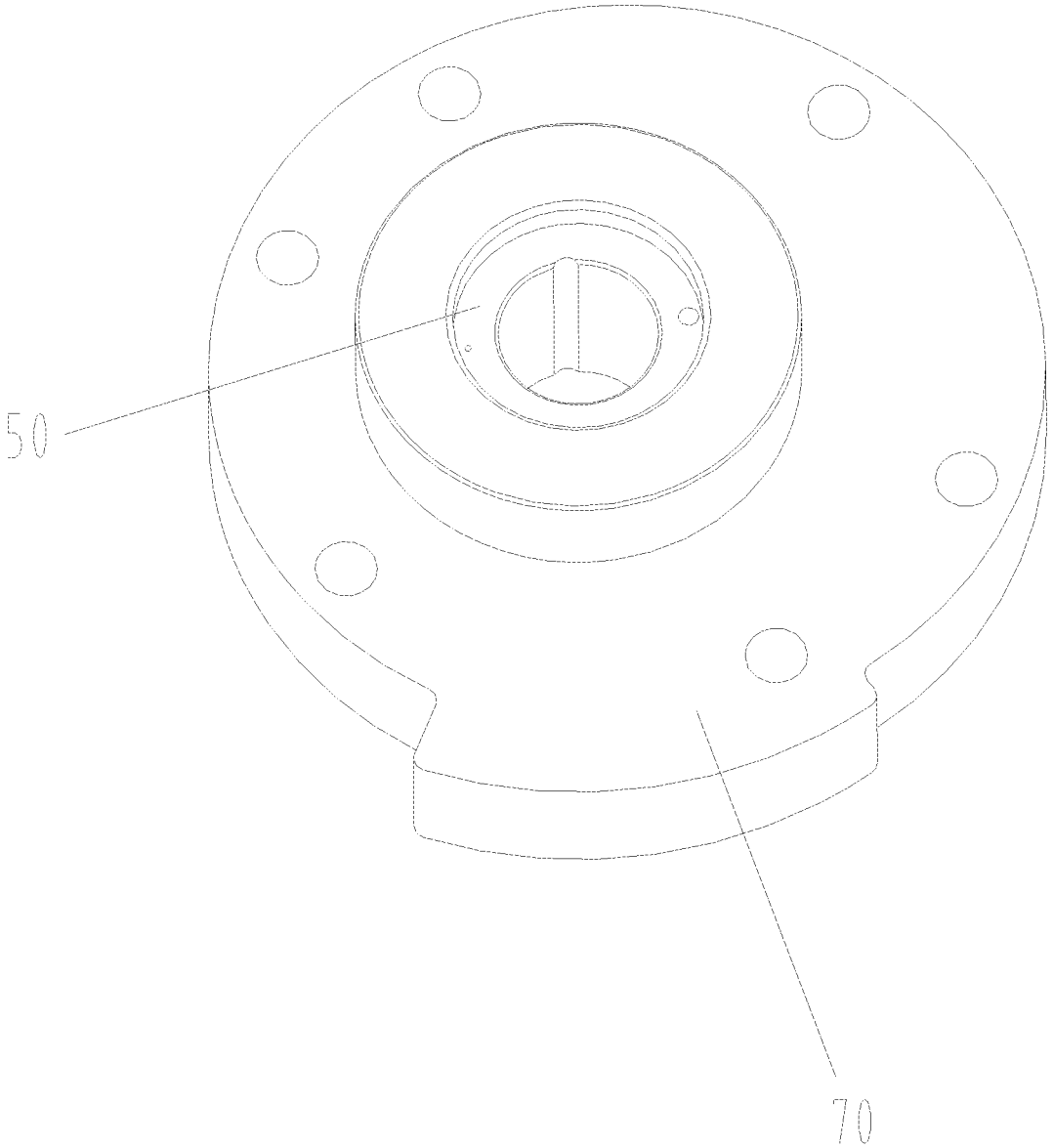
FIG. 12 shows a schematic structural diagram of the second viewing angle of a lower flange of a pump body assembly according to the present disclosure.

In order to be able to store a certain amount of lubricating oil in the back pressure member, as shown in FIG. 4 and FIG. 12, the oil supply passage further includes an oil cavity 50 arranged on at least one of the two back pressure members, wherein the oil cavity 50 is communicated with the oil passage 22 and the oil cavity 50 is communicated with the flow passage 40 so that the oil passage 22 is communicated with the first flow passage 41 through the oil cavity 50, and the oil passage 22 is communicated with the second flow passage 42 through the oil cavity 50; the flow passage 40 is disposed between the oil cavity 50 and the back pressure groove 10.

In the embodiment, by providing the oil cavity 50 on the back pressure member, the oil cavity 50 is communicated with the oil passage 22, and the oil cavity 50 is communicated with the flow passage 40 so that the oil passage 22 is communicated with the first flow passage 41 through the oil cavity 50 and the oil passage 22 is communicated with the second flow passage 42 through the oil cavity 50, that is, the lubricating oil in the oil passage 22 enters the oil cavity 50 for storage and then flows into the first flow passage 41 and the second flow passage 42.

In the present embodiment, the flow passage 40 is disposed between the oil cavity 50 and the back pressure groove 10, and the inner wall of the oil cavity 50 is a circular arc.

In order to prevent the sliding vane 30 from being collided due to an excessive retraction in the exhaust section, as shown in FIG. 13, the back pressure groove 10 further includes a third groove section 13, wherein the second groove section 12 is disposed between the third groove section 13 and the first groove section 11 and the width of the third groove section 13 is smaller than the width of the second groove section 12.

In the present embodiment, by providing the third groove section 13 on the back pressure groove 10, and the width of the third groove section 13 being smaller than the width of the second groove section 12, in the exhaust section, it is possible to ensure sufficient oil pressure in the sliding vane groove 21, that is, an oil-hold is generated in the sliding vane groove 21.

In the present embodiment, the third groove section 13 and the sliding vane tail groove 31 are arranged in an on-off mode, that is, in the exhaust section, the third groove section 13 is in communication with the sliding vane tail groove 31, and the second groove section 12 is disposed between the third groove section 13 and the first groove section 11 in order to satisfy each section of the pump body assembly.

In order to prevent excessive oil-hold in the sliding vane groove 21, the third groove section 13 is communicated with the oil supply passage.

In the present embodiment, since the width of the third groove section 13 is smaller than the width of the second groove section 12, that is, in the air exhaust section, the oil-hold occurs in the sliding vane groove 21. However, considering that the pressure difference between the two ends of the sliding vane 30 is too high when the oil-hold in the sliding vane groove 21 is too high so that the power consumption of the sliding vane head portion 30 is too high, the third groove section 13 is communicated with the oil supply passage so that the lubricating oil in the sliding vane groove 21 can partially leak through the oil supply passage.

In some embodiments, the third groove section 13 is communicated with the second groove section 12.

In the present embodiment, the third groove section 13 is communicated with the second flow passage 42.

Optionally, the third groove section 13 and the second groove section 12 are disposed at intervals and the flow passage 40 further includes a third flow passage. The third groove section 13 is in communication with the third flow passage such that the third groove section 13 is communicated with the oil passage 22 through the third flow passage.

In the present embodiment, the third groove section 13 is an arc groove.

For the specific structure of the first flow passage 41 and the second flow passage 42, the cross-section of the first flow passage 41 is of circular-shaped or polygonal-shaped and the cross-section of the second flow passage 42 is circular-shaped or polygonal-shaped.

Optionally, the cross-section of the first flow passage 41 and the second flow passage 42 is quadrangular.

In some embodiments, the first groove section 11 is an arc groove and/or the second groove section 12 is an arc groove.

Figure 3:
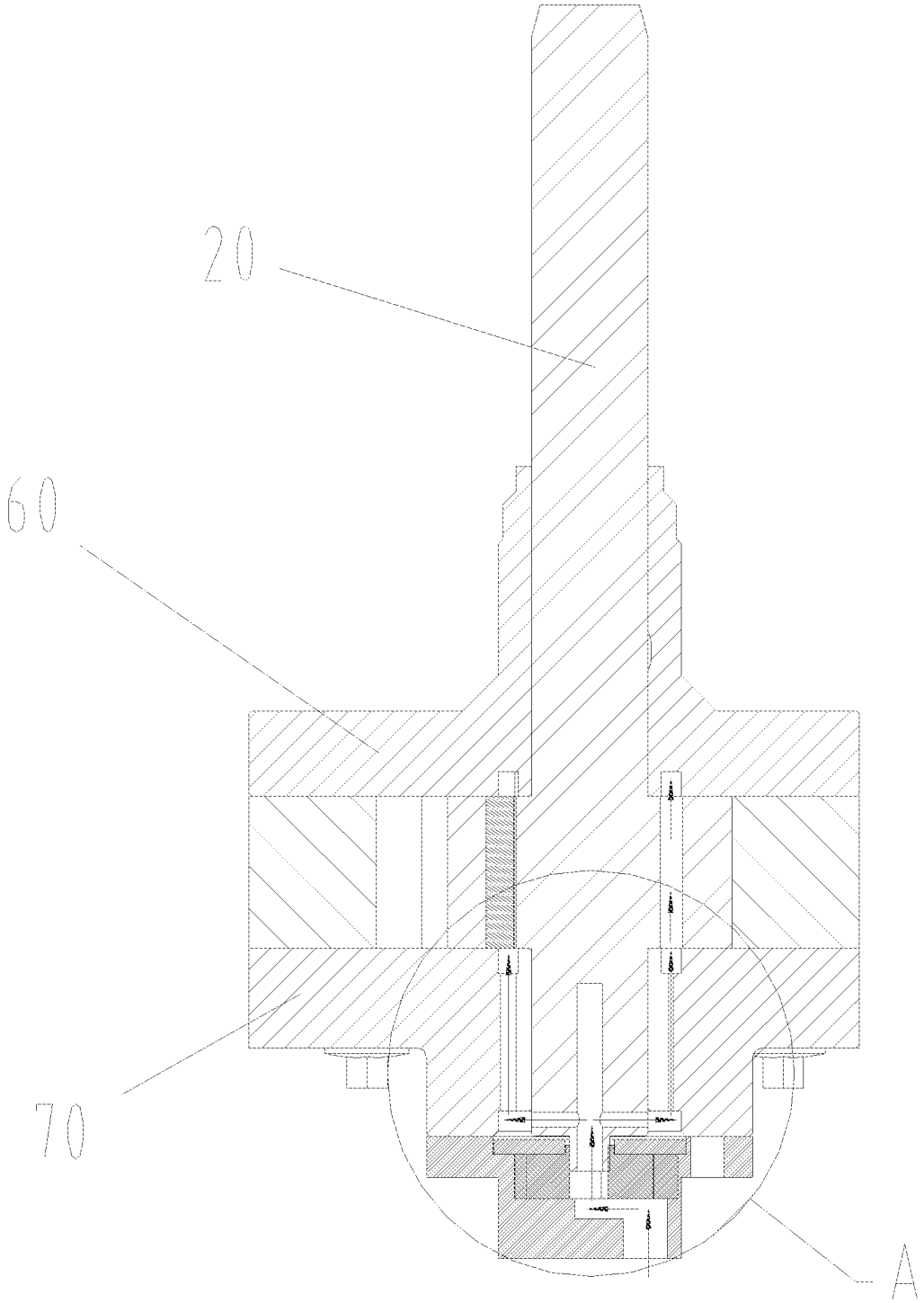
FIG. 3 shows a schematic cross-sectional structural diagram of a pump body assembly according to the present disclosure.

Concerning the specific distribution of the two back pressure members, as shown in FIG. 2 and FIG. 3, the two back pressure members are an upper flange 60 and a lower flange 70 respectively. The back pressure groove 10 is disposed on the end face, facing the lower flange 70, of the upper flange 60; and the back pressure groove 10 is disposed on the end face, facing the upper flange 60, of the lower flange 70.

In the present embodiment, the two back pressure members are an upper flange 60 and a lower flange 70, respectively, and the sliding vane 30 is arranged between the upper flange 60 and the lower flange 70. Wherein the back pressure groove 10 is disposed on the end face, facing the lower flange 70, of the upper flange 60, and the back pressure groove 10 is disposed on the end face, facing the upper flange 60, of the lower flange 70, that is, at least one of the upper flange 60 and the lower flange 70 is provided with the back pressure groove 10.

In some embodiments, each of the upper flange 60 and the lower flange 70 is provided with the back pressure groove 10, and the projection of the back pressure groove 10 on the upper flange 60 onto the lower flange 70 coincides with the back pressure groove 10 on the lower flange 70.

In the present embodiment, both the upper flange 60 and the lower flange 70 are provided with the back pressure grooves 10, and the back pressure groove 10 on the upper flange 60 and the back pressure groove 10 on the lower flange 70 are identical in a specific structure. Herein, each of the lower flange 70 and the upper flange 60 is provided with the flow passage 40.

Concerning one specific embodiment of the pump body assembly, the two back pressure members are an upper flange 60 and a lower flange 70 respectively. The back pressure groove 10 is disposed on the end face, facing the lower flange 70, of the upper flange 60, and the back pressure groove 10 is disposed on the end face, facing the upper flange 60, of the lower flange 70, and the lower flange 70 is provided with at least part of the oil supply passage.

In the present embodiment, both the upper flange 60 and the lower flange 70 are provided with the back pressure grooves 10, and the lower flange 70 is provided with the flow passage 40 and the oil cavity 50.

In order to ensure sufficient lubricating oil in the oil supply passage, as shown in FIG. 2 and FIG. 4, the pump body assembly further includes a pump body 80, wherein the oil outlet of the pump body 80 is communicated with the oil supply passage so that the pump body 80 conveys the oil in the oil tank into the oil supply passage.

In the present embodiment, by providing the pump body 80 on the pump body assembly, and communicating the oil outlet of the pump body 80 with the oil supply passage, so that the pump body 80 can be enabled to convey the oil in the oil tank into the oil supply passage, thereby ensuring that the sliding vane groove 21 is filled with the lubricating oil.

Figure 18:
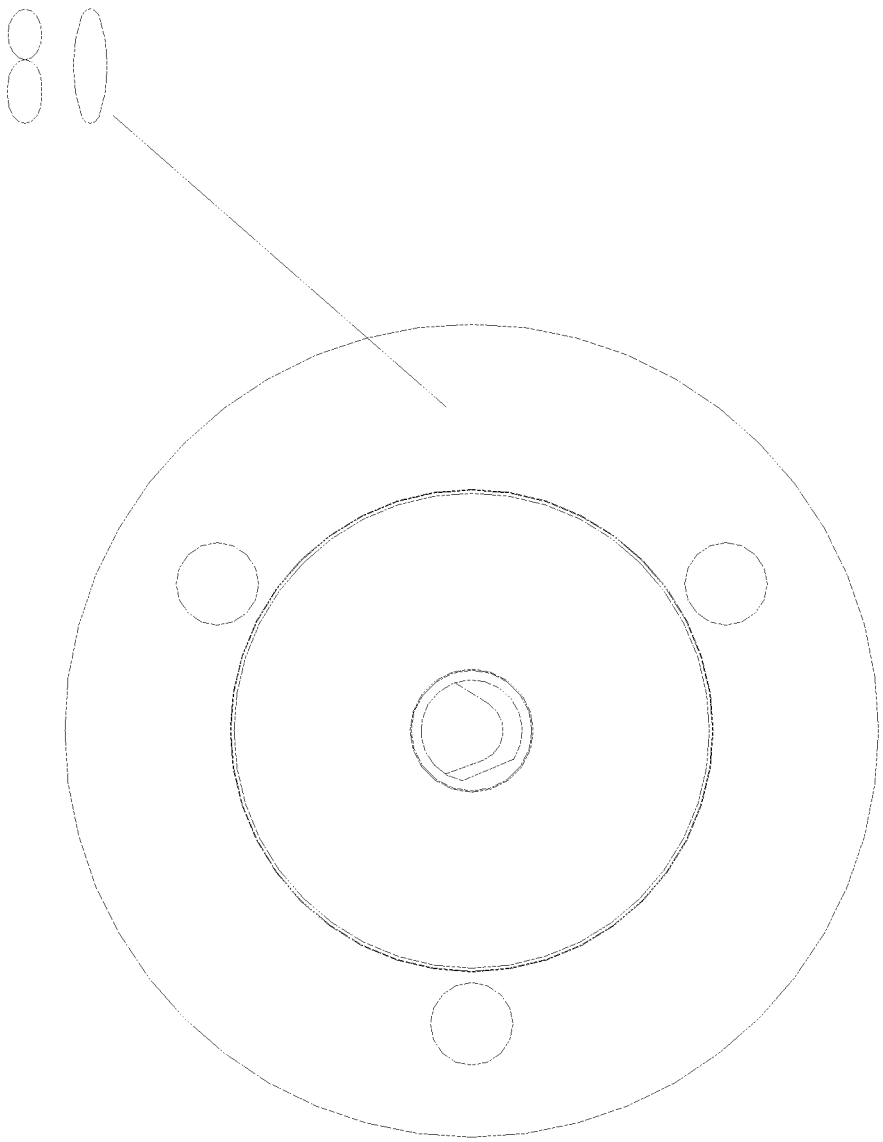
FIG. 18 shows a schematic structural diagram of the first viewing angle of a pump body of a pump body assembly according to the present disclosure.
Figure 19:
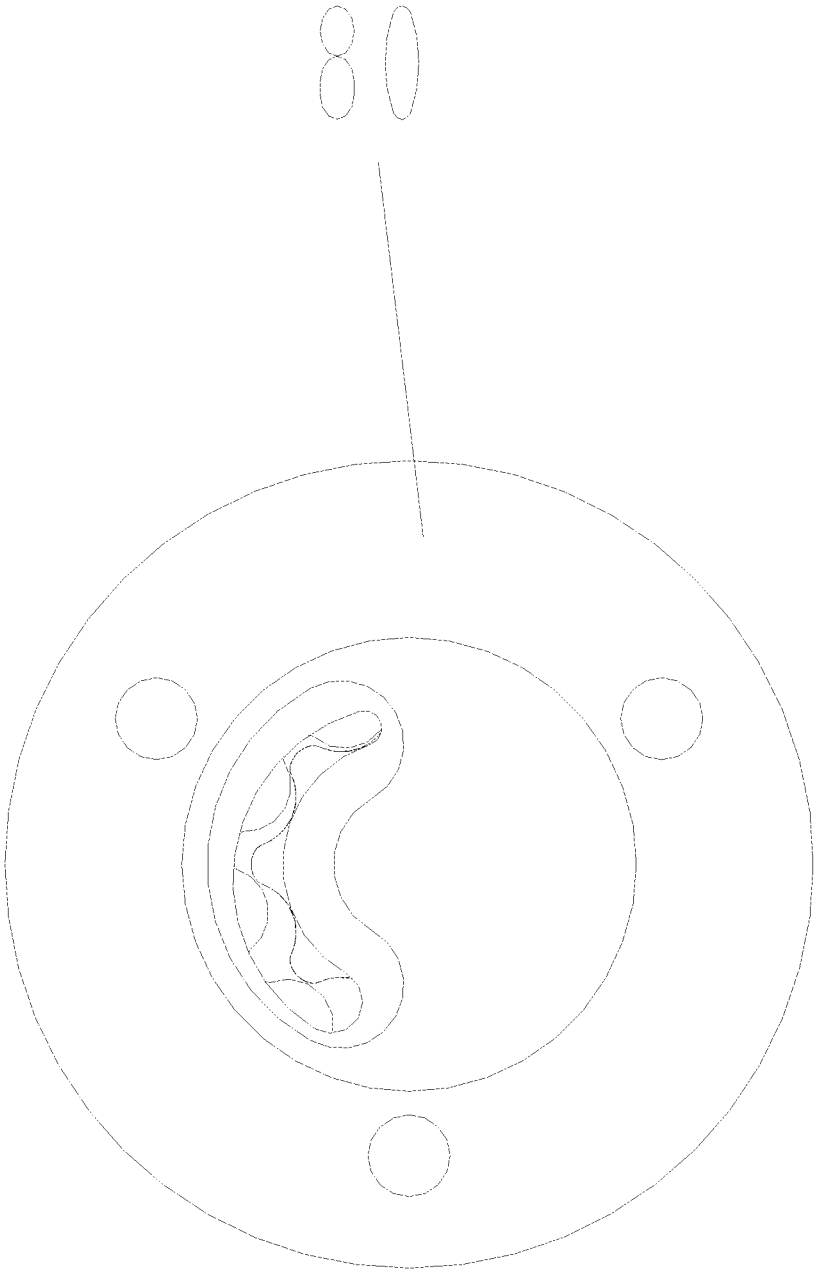
FIG. 19 shows a schematic structural diagram of the second viewing angle of a pump body of a pump body assembly according to the present disclosure.
Figure 20:
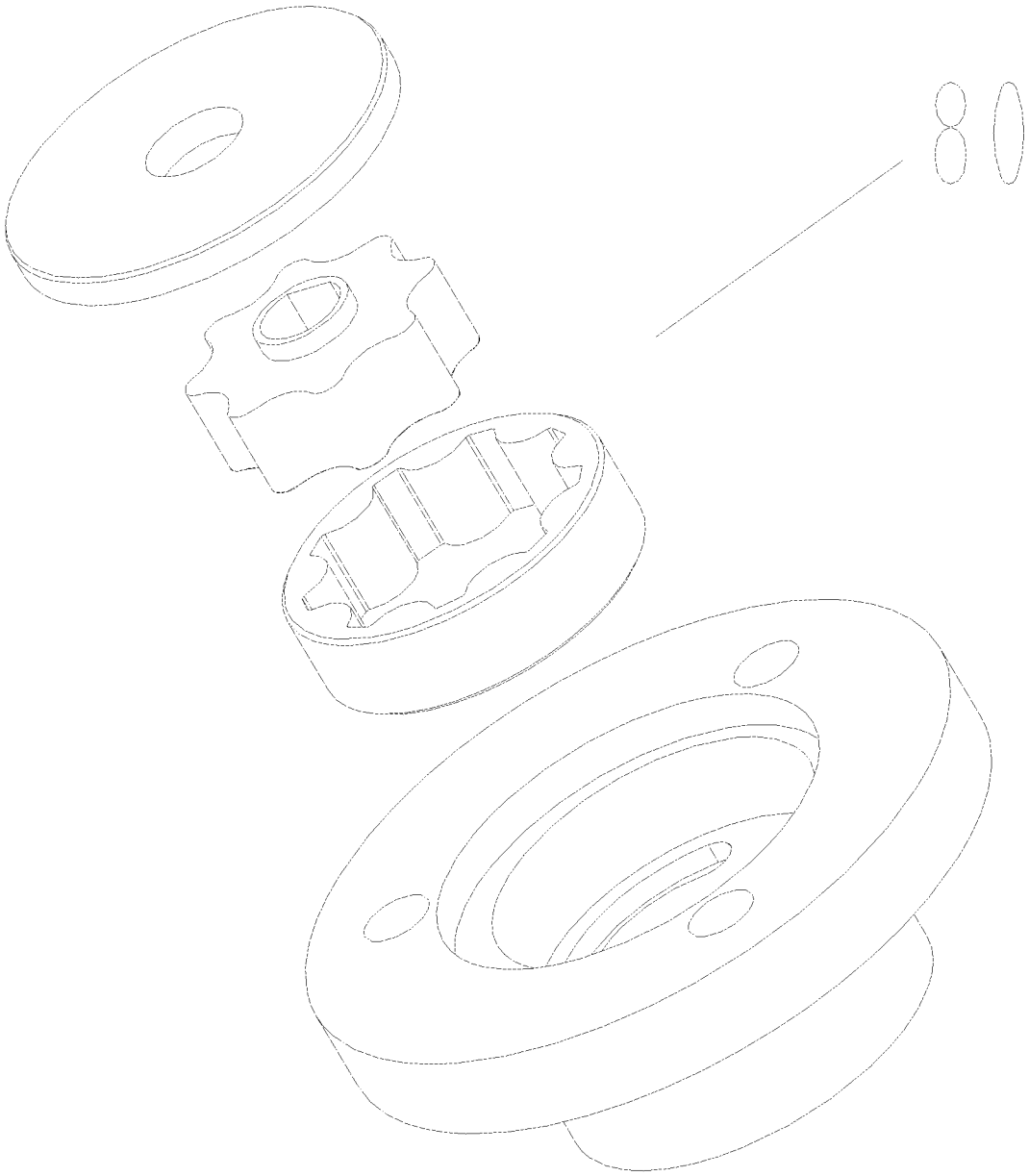
FIG. 20 shows a schematic cross-sectional structural diagram of a pump body of a pump body assembly according to the present disclosure.

Concerning the specific structure of the pump body 80, as shown in FIGS. 18 to 20, the pump body 80 is an oil pump and the oil pump is a gear oil pump.

Figure 16:
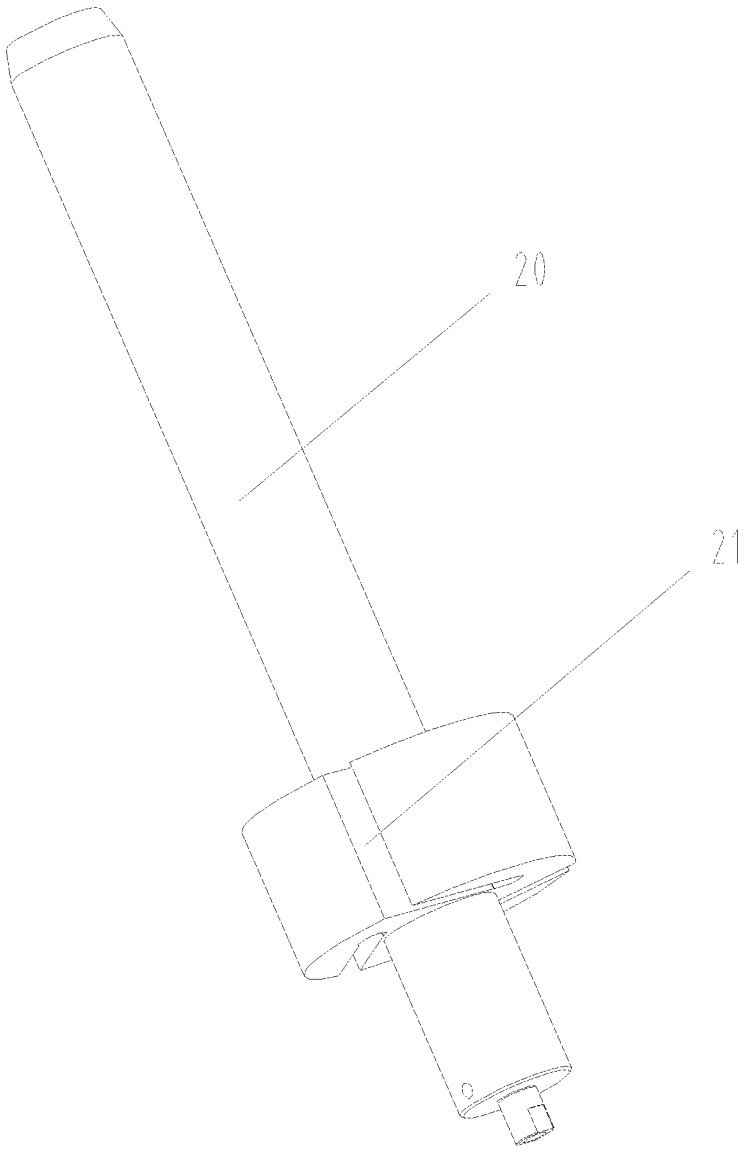
FIG. 16 shows a schematic structural diagram of a rotary shaft of a pump body assembly according to the present disclosure.
Figure 17:
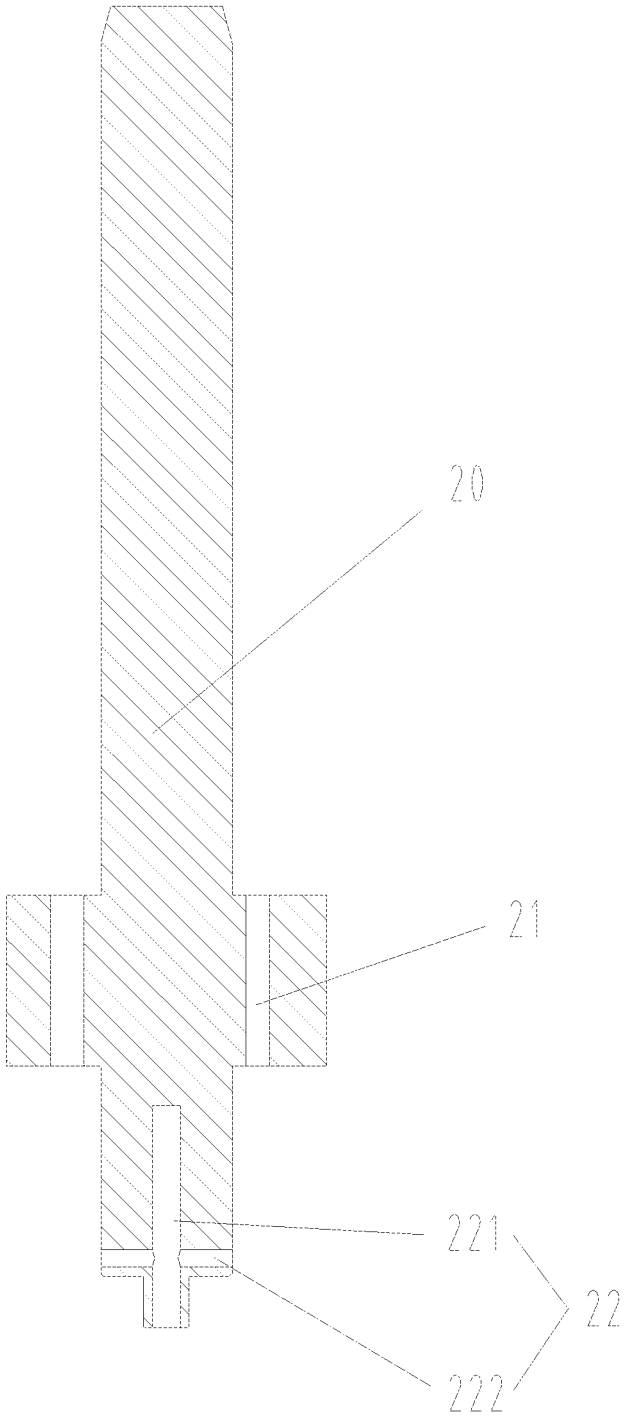
FIG. 17 shows a schematic cross-sectional structural diagram of a rotary shaft of a pump body assembly according to the present disclosure.

In the present embodiment, concerning the specific structure of the rotary shaft 20, as shown in FIG. 16 and FIG. 17, the oil passage 22 includes a central hole 221 and a radial hole 222, and the radial hole 222 is communicated with the central hole 221, wherein the central hole 221 is communicated with the oil outlet of the pump body 80 and the radial hole 222 is communicated with the oil cavity 50.

The disclosure also provides a compressor which includes a pump body assembly, wherein the pump body assembly is the pump body assembly described above.

The suction of the sliding vane compressor goes though an angle, and the pressure difference of force between the sliding vane tail portion and the sliding vane head portion ($F_{back}-F_{head}$) is maximum because the sliding vane head portion is under the suction pressure in the suction section. In addition, the sliding vane moves with the sliding vane groove in an extending movement in the suction section, and the rotation radius of the sliding vane head portion is in the process of increasing, that is, the linear velocity of the sliding vane head portion is increasing. According to $W=f\cdot v$, in the suction section, the power consumption of the sliding vane head portion is not only large, but also in the process of increasing, so that the power consumption of the sliding vane head portion in the suction section occupies a large proportion in the whole operation period of the sliding vane and reducing the power consumption at this position has a significant effect on reducing the power consumption of the whole machine.

In addition, because the pressure drop along the sliding vane back pressure oil flow passage and the over-compression exist, the back pressure at the tail portion of the sliding vane in the exhaust section of the conventional scheme cannot meet the requirement of ensuring that the sliding vane always clings to the inner wall of the cylinder, the sliding vane has the risk of being separated, the sliding vane is easy to collide, and the reliability of the sliding vane and the noise vibration of the whole compressor are influenced. Therefore improving the back pressure of the exhaust section and ensuring that the sliding vane does not retreat are crucial to the reliability and the noise vibration of the compressor.

The compressor of the present disclosure is a new sliding vane compressor. The control manner of tail back pressure of the sliding vane compressor is to divide a traditional back pressure groove into three sections, namely a suction section, a compression section and an exhaust section, wherein the corresponding back pressure of each section is different so that a low back pressure is provided in the suction section with low pressure at the sliding vane head portion, and a back pressure higher than the exhaust pressure is provided in the exhaust section with higher pressure than the exhaust pressure at the head portion.

According to the disclosure, the sliding vane back pressure groove is divided into three sections, a suction section, a compression section and an exhaust section, wherein the suction section is separated from the compression section and the suction section is separated from the exhaust section by a transition section, and high-pressure oil of the compression section and the exhaust section is prevented from being communicated to the suction section to influence the back pressure of the suction section.

The sliding vane back pressure groove adopts three-section back pressure, wherein the suction section adopts a low back pressure to reduce power consumption, the compression section adopts a high back pressure of exhaust pressure, and the exhaust section adopts an oil-hold groove design to generate a back pressure higher than the exhaust pressure.

According to the disclosure, the pressure control of the three-section back pressure is realized by the means as followed: the back pressure oil (P) is divided into two passages from the main passage and respectively leads to a suction section back pressure groove (the first groove section 11), a compression section back pressure groove (the second groove section 12) and an exhaust section back pressure groove (the third groove section 13), wherein the oil passage (the first flow passage 41) leading to the suction section back pressure groove is narrow, and throttling pressure reduction ($\Delta$ P1) of the oil is realized through a small-caliber oil passage so that a low back pressure (P−$\Delta$ P1) of the suction section is achieved. The oil passage leading to the back pressure groove of the compression section and the exhaust section is a large-caliber oil passage (the second flow passage 42), so that the oil is prevented from being lost along the passage, the back pressure oil is ensured not to generate pressure drop, and the high back pressure (P) of the compression section is realized. The sliding vane is in an extending movement in the exhaust section, wherein the space of the sliding vane groove at the tail portion of the sliding vane decreases along with the movement of the sliding vane and the back pressure groove herein is designed to be a shallow and narrow small groove. Due to the incompressibility of the oil, the tail portion of the sliding vane groove can generate an oil-hold pressure ($\Delta$ P2) such that the ultra-high back pressure (P+$\Delta$ P2) of the exhaust section is realized. The shallow and narrow back pressure groove not only can realize the improvement of the effect of the back pressure by enabling the sliding vane to retract to hold oil, but also can provide a proper oil drain passage to prevent the oil pressure from being too high.

The suction section of the present disclosure is a section from the beginning of suction to the beginning of compression, the compression section is a section from the beginning of compression to the beginning of exhaust, the exhaust section is a section from the beginning of exhaust to the end of exhaust, and the respective angle ranges thereof are different according to different compressor pump body structures.

The design of the cross-sectional area of the oil passage leading to the suction section is determined by the length of the oil passage and the lowest operating frequency so that the ideal pressure drop Δ P1 can be realized under the conditions of the lowest oil rotating velocity and the lowest oil flowing velocity. According to the design of the cross-sectional area of the oil passage leading to the compression section and the exhaust section, oil pressure drop along the passage will not generated under the conditions of the highest operating frequency and the highest oil flowing velocity.

According to the design of the oil-hold groove in the exhaust section of the disclosure, sufficient oil-hold pressure Δ P2 can be guaranteed at the lowest operating frequency, and sufficient oil drain can be guaranteed at the highest operating frequency, and Δ P2 is prevented from being too high.

According to the disclosure, each of the upper flange and the lower flange is provided with the back pressure groove, so that the stability of the back pressure is ensured, and the uneven stress of the upper end and the lower end of the sliding vane and the deflection of the sliding vane can be effectively prevented.

According to the disclosure, the oil supply is actively supplied by the oil pump at the bottom of the main shaft (the rotary shaft 20), so that the whole sliding vane back pressure cavity can be filled with oil at all times, and a precondition is provided for oil-hold of the exhaust section.

According to the disclosure, through the three-section back pressure structure, the back pressure of the sliding vane in the suction section can be reduced, so that the power consumption of the sliding vane head portion is reduced. The back pressure of the sliding vane is improved in the exhaust section such that the sliding vane is ensured not to be separated, the flexible control of the back pressure of the sliding vane is realized, the reliability of the sliding vane and the noise vibration of the compressor are improved, and the overall performance of the compressor is improved.

According to the disclosure, the structure is simple and parts are easy to process and assemble.

FIG. 2 is an exploded view of the pump body assembly of the present disclosure, including parts such as the main shaft (rotary shaft 20), a cylinder 90, an upper flange 60, a lower flange 70, an oil pump, a sliding vane 30, a screw 100, an exhaust valve 110, etc.

In the present embodiment, as shown in FIGS. 9 to 15, the end faces of the flanges are respectively provided with back pressure grooves 10. The back pressure groove is an annular groove with a certain depth. The back pressure groove is divided into a suction section, a compression section and an exhaust section, wherein the back pressure groove of the exhaust section is a relatively shallow and narrow oil-hold groove, and two transition sections separated from the compression section and the exhaust section are respectively arranged before and after the suction section.

In the present embodiment, the main shaft is provided with a central hole 221 and a radial hole 222 for oil circulation. The oil pump is a gear oil pump and is assembled with the main shaft through a D-shaped small shaft at the bottom of the main shaft.

Figure 15:
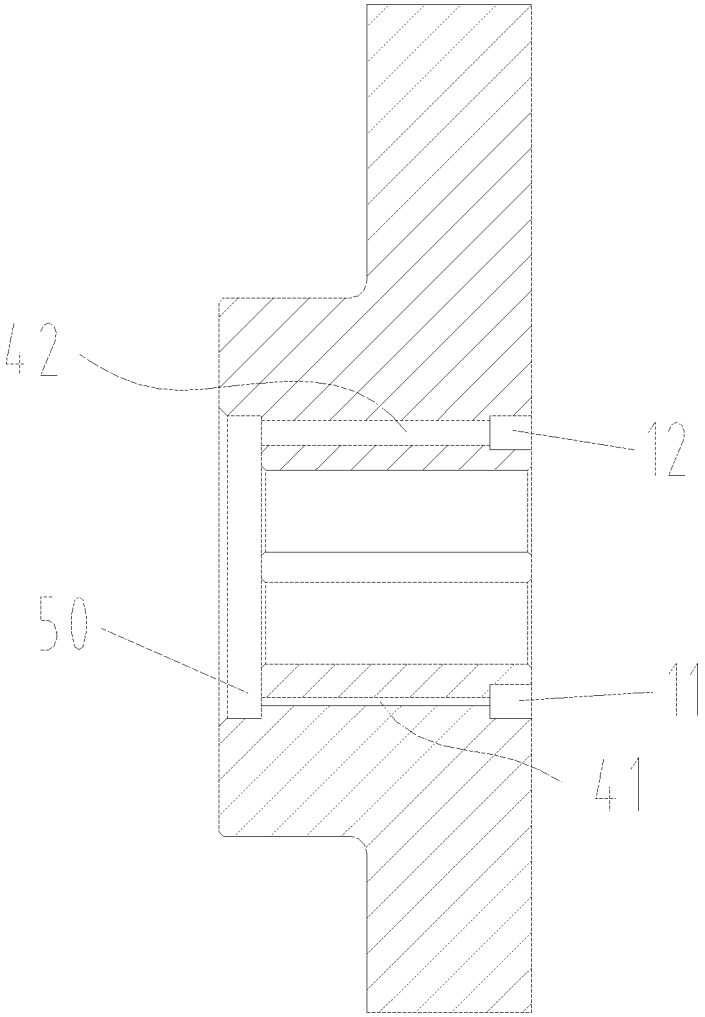
FIG. 15 shows a schematic cross-sectional structural diagram of a lower flange of a pump body assembly according to the present disclosure.

Concerning the suction section oil passage (flow passage 40) of the disclosure, the suction section oil passage, the compression section oil and the exhaust section oil passage are straight holes having a certain length and a cross-section. The straight holes are all provided on the lower flange 70, as shown in FIG. 15.

Operating of the embodiments as follow:

Section One: when the compressor operates the main shaft to rotate, the oil pump assembled at the bottom of the main shaft rotates to pump the oil into the central hole. Along with the rotation of the main shaft, oil in the central hole enters the oil cavity formed by the lower flange and the oil pump through the radial hole on the main shaft under the action of the centrifugal force, and then enters the back pressure groove of the flange through the suction section oil passage and the compression section and the exhaust section oil passage respectively. Due to the throttling of the suction section oil passage, the oil pressure of the suction section is reduced by Δ P1, the oil pressure of the suction section is reduced to P−Δ P1. Herein, the refrigerant enters the compression cavity through the suction port 120.

Figure 5:
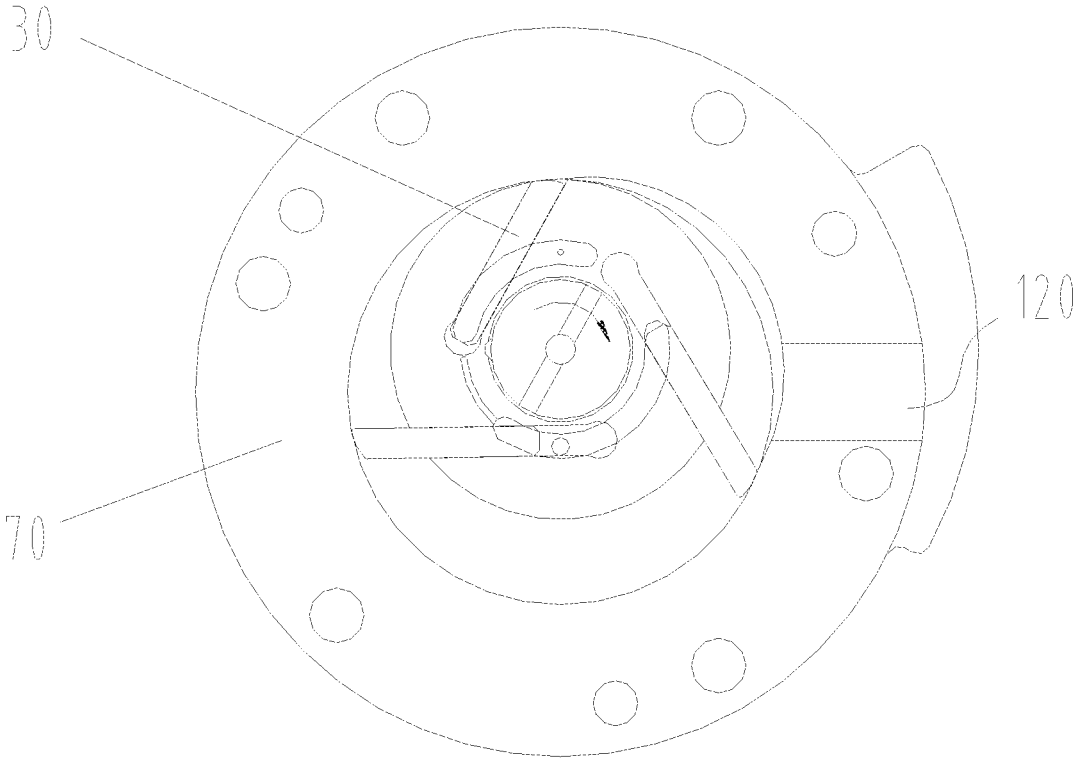
FIG. 5 shows a schematic structural diagram of the first state of a pump body assembly according to the present disclosure.

Section Two: FIGS. 5 to 8 show the actual movement process of the pump body. Taking one of the sliding vanes 30 as an object (the sliding vane with the reference numeral 30 in the figure), when the sliding vane is at the beginning of the suction groove as shown in FIG. 5, that is, near the zero degree angle, the sliding vane tail groove (sliding vane groove 21) is just communicated with the back pressure groove of the suction section. As the main shaft rotates, the sliding vane 30 reaches the position in FIG. 6, which is the end of the suction. The sliding vane tail groove is about to be disconnected from the back pressure groove of the suction section and enters the transition region.

Figure 6:
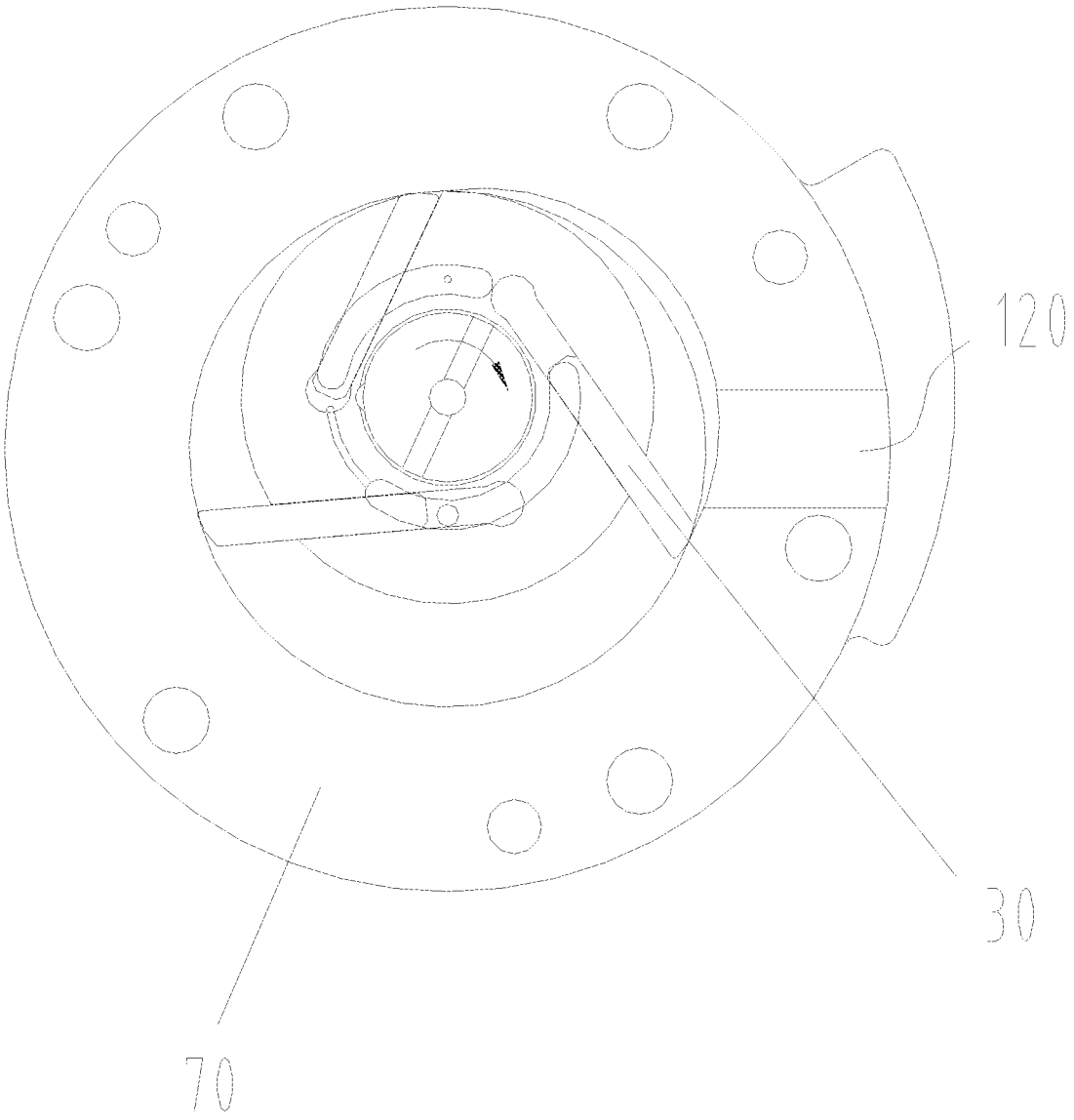
FIG. 6 shows a schematic structural diagram of the second state of a pump body assembly according to the present disclosure.

Section Three: as the sliding vane continues to move through the FIG. 6, the sliding vane tail groove is to be separated from the transition region and communicated with the compression section back pressure groove. After a certain angle, the refrigerant in the pump body is compressed and is about to exhaust. At the moment, the sliding vane tail groove is to be separated from the compression section and enters the exhaust section.

Figure 7:
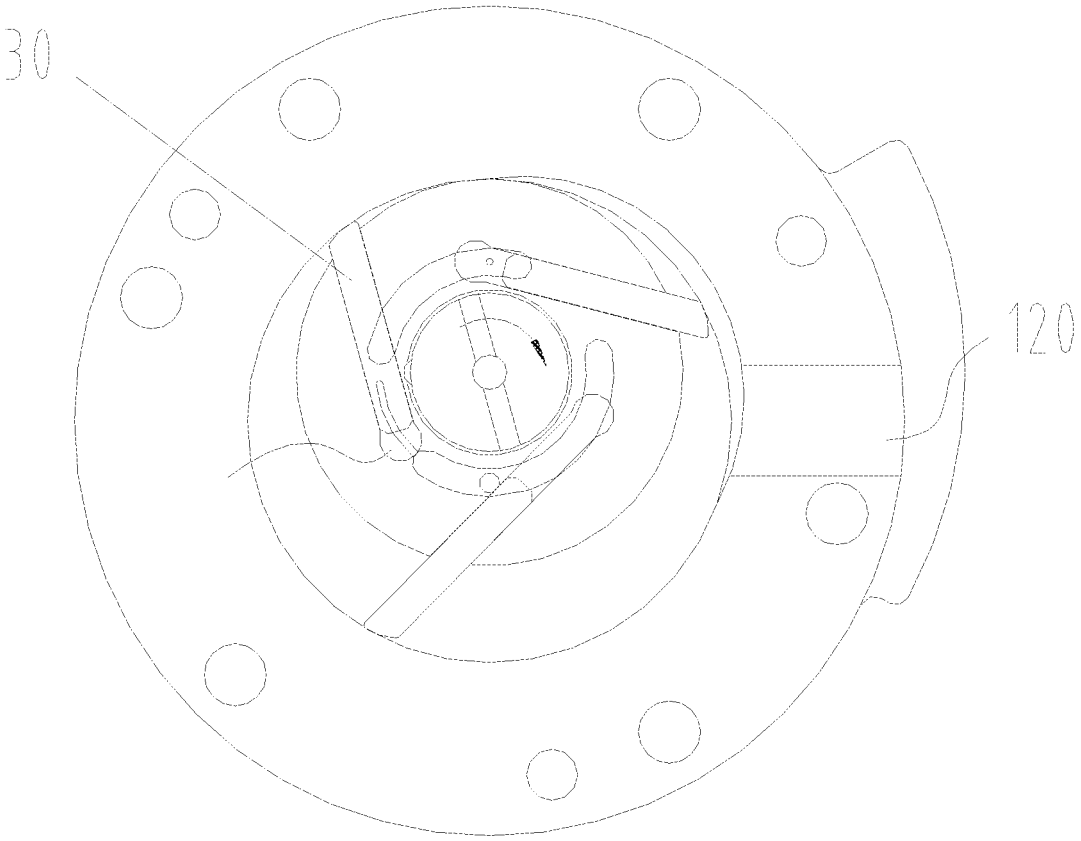
FIG. 7 shows a schematic structural diagram of the third state of a pump body assembly according to the present disclosure.
Figure 8:
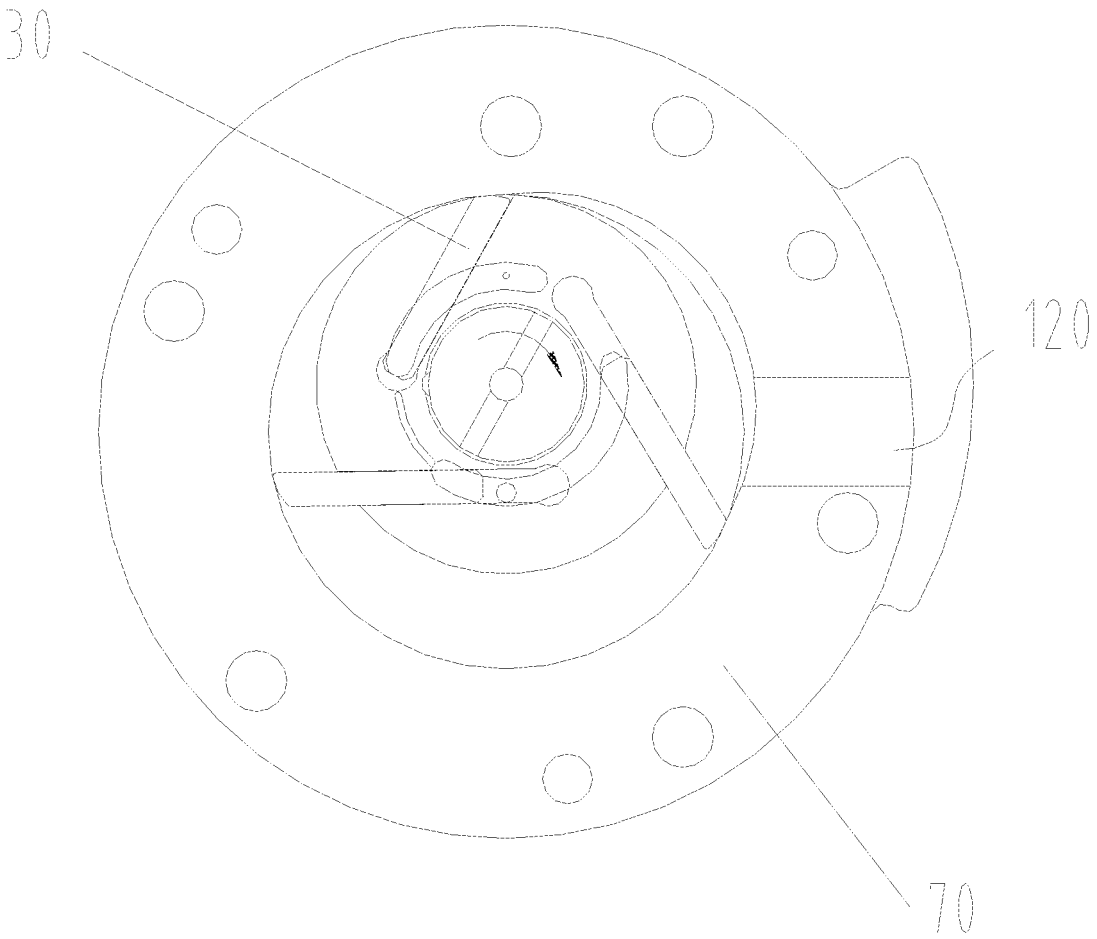
FIG. 8 shows a schematic structural diagram of the fourth state of a pump body assembly according to the present disclosure.
Figure 9:
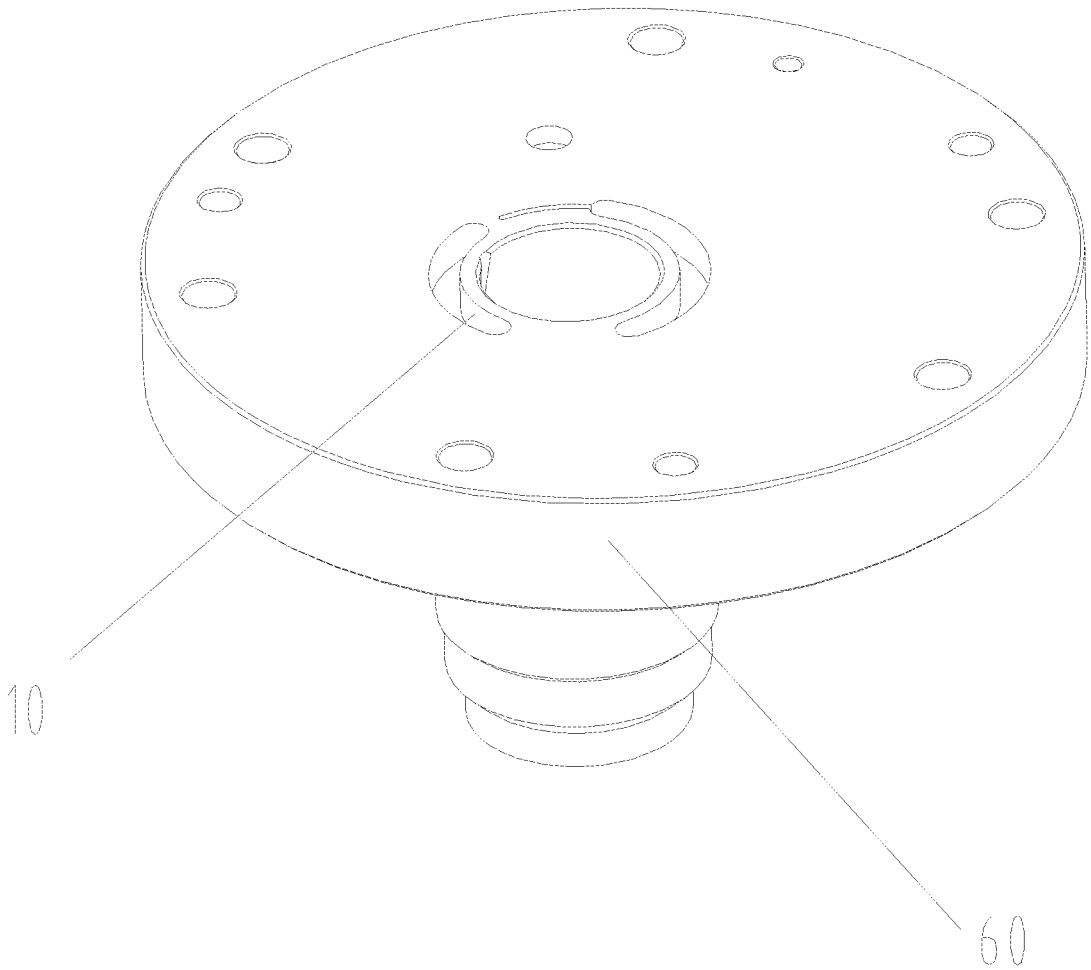
FIG. 9 shows a schematic structural diagram of the first viewing angle of an upper flange of a pump body assembly according to the present disclosure.
Figure 10:
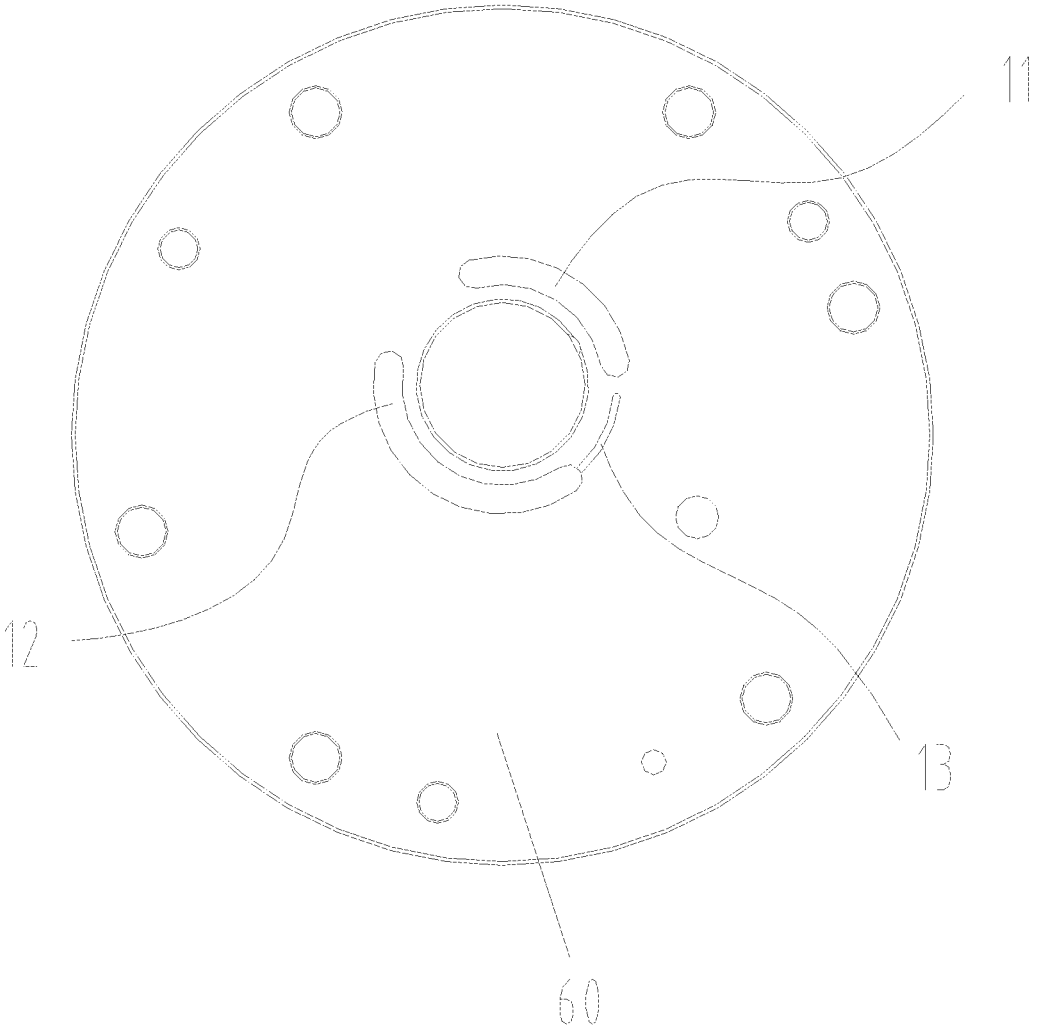
FIG. 10 shows a schematic structural diagram of the second viewing angle of an upper flange of a pump body assembly according to the present disclosure.
Figure 11:
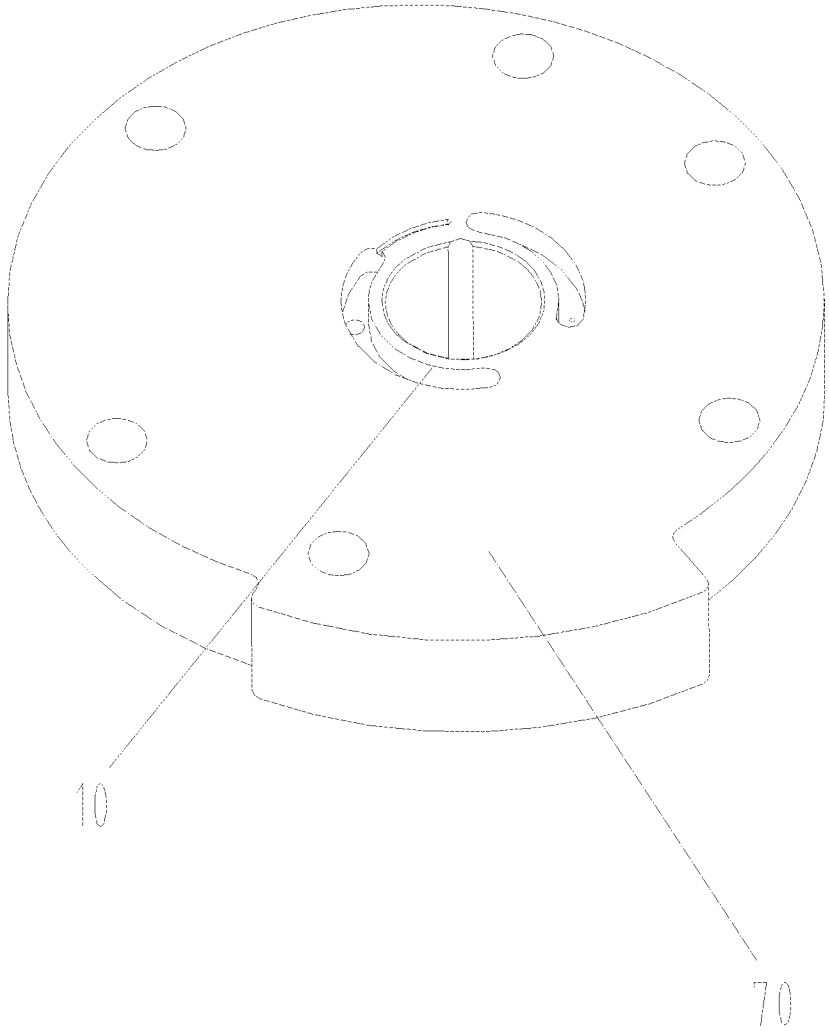
FIG. 11 shows a schematic structural diagram of the first viewing angle of a lower flange of a pump body assembly according to the present disclosure.

Section Four: as the sliding vane continues to move along with the rotation direction, the sliding vane enters the exhaust section and reaches the positions shown in FIG. 7 and FIG. 8. The volume of the tail groove $V_{tail}$ of the sliding vane is gradually reduced in the whole process, where the oil in the tail groove of the sliding vane is compressed and flows out of the oil-hold groove along with the reduction of the $V_{tail}$. But since the rotation velocity of the sliding vane is fast, the volume change rate of the $V_{tail}$ is large, the cross-section area of the oil-hold groove is small, and the oil is incompressible, a pressure (P−Δ P2) higher than the original pressure is formed in the sliding vane tail groove so that the back pressure is improved compared with the device known to inventors.

As the sliding vane continues to move, the sliding vane reaches the position in FIG. 5, completing a complete cycle, that is completing one suction-compression-exhaust process.

From the above description, it can be seen that the above-described embodiments of the present disclosure achieve the following technical effects.

According to the pump body assembly disclosed by the disclosure, by reducing the area in which the first groove section 11 is communicated with the oil supply passage, the oil inlet quantity in the sliding vane tail groove 31 can be reduced in the suction section of the pump body assembly, so that the pressure difference between the two ends of the sliding vane 30 is reduced and the power consumption of the sliding vane head portion 30 can be reduced. In the suction section of the pump body assembly, the sliding vane tail groove 31 is communicated with the first groove section 11, and the oil enters the sliding vane groove 21 sequentially through the oil supply passage and the first groove section 11. In the oil inlet process, the communication area of the first groove section 11 and the oil supply passage is small so that the oil inlet quantity in the sliding vane tail groove 31 is reduced and the pressure difference between the two ends of the sliding vane 30 is reduced. In the compression section, the sliding vane tail groove 31 is communicated with the second groove section 12, and the oil enters the sliding vane groove 21 through the oil supply passage and the second groove section 12 sequentially. In the oil inlet process, because the communication area of the second groove section 12 and the oil supply passage is larger than the communication area of the first groove section 11 and the oil supply passage, the oil inlet quantity in the sliding vane tail groove 31 is increased. This ensures that the pressure difference between two sides of the sliding vane 30 is sufficient to locate the sliding vane 30 in a reliable position. According to the pump body assembly of the disclosure, by reducing the communication area of the first groove section 11 and the oil supply passage, the oil inlet quantity in the sliding vane tail groove 31 can be reduced in the suction section of the pump body assembly so that the pressure difference between the two ends of the sliding vane 30 is reduced, the power consumption of the sliding vane head portion 30 can be reduced, and the problem of large power consumption of the sliding vane head portion in the suction section of the pump body assembly in is solved.

It should be noted that the terms "first", "second", and the like in the description and claims of the present disclosure and in the above-mentioned drawings are used for distinguishing between similar objects and not necessarily for describing a particular order or sequential order. It is to be understood that the data so used are interchangeable under appropriate circumstances such that the some embodiments of the disclosure described herein are, for example, capable of operation in sequences other than those illustrated or described herein. Furthermore, the terms "comprise", and "having", as well as any variations thereof, are intended to cover a non-exclusive inclusion. For example, a process, method, system, article, or apparatus that comprises a list of steps or elements is not necessarily limited to those steps or elements expressly listed, but may include other steps or elements not expressly listed or inherent to such process, method, article, or apparatus.

For ease of description, spatially relative terms, such as "beyond", "above", "upper surface", "on", and the like, may be used herein to describe the spatial positional relationship of one device or feature to other devices or features as shown in the figures. It is to be understood that spatially relative terms are intended to encompass different orientations in use or operation in addition to the orientation of the device depicted in the figures. For example, a device described as "over other devices or constructions" or "on other devices or constructions" would be located "under other devices or constructions" or "below other devices or constructions" after the device is inverted. Therefore, the exemplary term "above" may include both "above" and "below" orientations. The device may also be located in other different ways (rotated 90 degrees or in other orientations) and the spatial relative description used herein will be explained accordingly.

The foregoing are only some embodiments of the disclosure and are not intended to limit the disclosure. Various modifications and changes may be made to the disclosure by those skilled in the art. Any modifications, equivalents, improvements, etc. that come within the spirit and principle of the disclosure are intended to be included within the scope of the disclosure.

What is claimed is:

1. A pump body assembly, comprising:

an oil supply passage configured for circulating oil;

two back pressure members, wherein at least one back pressure member of the two back pressure members is provided with a back pressure groove, the back pressure groove comprises a first groove section and a second groove section, the first groove section and the second groove section are disposed at intervals, the first groove section is communicated with the oil supply passage, and the second groove section is communicated with the oil supply passage; wherein wherein the oil supply passage comprises:

a flow passage disposed in the at least one back pressure member, wherein the flow passage comprises a first flow passage and a second flow passage, the first flow passage and the second flow passage are through holes penetrating the at least one back pressure member, the first flow passage is communicated with the first groove section, and the second flow passage is communicated with the second groove section;

wherein an area of a first opening, communicated with the first groove section, of the first flow passage is a, and an area of a second opening, communicated with the second groove section, of the second flow passage is b, and $a<b$.

2. The pump body assembly as claimed in claim 1, wherein the pump body assembly further comprises a rotary shaft which passes through the two back pressure members, and the oil supply passage further comprises:

an oil passage disposed on the rotary shaft, wherein the oil passage is communicated with the first flow passage and the oil passage is communicated with the second flow passage.

3. The pump body assembly as claimed in claim 2, wherein the oil supply passage further comprises:

an oil cavity provided on the at least one back pressure member, wherein the oil cavity is communicated with the oil passage and the oil cavity is communicated with the flow passage so that the oil passage is communicated with the first flow passage through the oil cavity, and the oil passage is communicated with the second flow passage through the oil cavity; wherein the flow passage is disposed between the oil cavity and the back pressure groove.

4. The pump body assembly as claimed in claim 1, wherein the back pressure groove further comprises:

a third groove section, wherein the second groove section is disposed between the third groove section and the first groove section;

wherein a width of the third groove section is smaller than a width of the second groove section.

5. The pump body assembly as claimed in claim 4, wherein the third groove section is communicated with the oil supply passage.

6. The pump body assembly as claimed in claim 4, wherein the third groove section is communicated with the second groove section.

7. The pump body assembly as claimed in claim 1, wherein a cross-section of the first flow passage is of circular-shaped or polygonal-shaped and a cross-section of the second flow passage is of circular-shaped or polygonal-shaped.

8. The pump body assembly as claimed in claim 1, wherein the first groove section is an arc groove and the second groove section is an arc groove.

9. The pump body assembly as claimed in claim 1, wherein the two back pressure members are an upper flange and a lower flange respectively, wherein the back pressure groove comprises two back pressure grooves, one of the two back pressure grooves is disposed on an end face of the upper flange facing the lower flange, and the other of the two back pressure grooves is disposed on an end face of the lower flange facing the upper flange.

10. The pump body assembly as claimed in claim 9, wherein a projection of the back pressure groove on the upper flange to the lower flange coincides with the back pressure groove on the lower flange.

11. The pump body assembly as claimed in claim 1, wherein the two back pressure members are an upper flange and a lower flange respectively, wherein the back pressure groove comprises two back pressure grooves, one of the two back pressure grooves is provided on an end face of the upper flange facing the lower flange, the other of the two back pressure grooves is provided on an end face of the lower flange facing the upper flange, and at least part of the oil supply passage is disposed on the lower flange.

12. The pump body assembly as claimed in claim 1, wherein the pump body assembly further comprises:

a pump body, wherein an oil outlet of the pump body is communicated with the oil supply passage so that the pump body conveys the oil in an oil tank into the oil supply passage.

13. The pump body assembly as claimed in claim 1, wherein a cross-section of the first flow passage is of circular-shaped or polygonal-shaped.

14. The pump body assembly as claimed in claim 1, wherein a cross-section of the second flow passage is of circular-shaped or polygonal-shaped.

15. The pump body assembly as claimed in claim 1, wherein the first groove section is an arc groove.

16. The pump body assembly as claimed in claim 1, wherein the second groove section is an arc groove.

17. The pump body assembly as claimed in claim 1, wherein the two back pressure members are an upper flange and a lower flange respectively, wherein the back pressure groove is provided on an end face of the upper flange facing the lower flange.

18. The pump body assembly as claimed in claim 1, wherein the back pressure groove is provided on an end face of the lower flange facing the upper flange.

19. A compressor, comprising the pump body assembly as claimed in claim 1.

* * * * *